US005197435A

United States Patent [19]

Mazur et al.

[11] Patent Number: 5,197,435

[45] Date of Patent: Mar. 30, 1993

[54] MOLDED FUEL INJECTION RAIL

[75] Inventors: Richard J. Mazur, Sylvania, Ohio; James D. Taylor, Temperance, Mich.; George H. Bucci, Tolland, Conn.

[73] Assignee: Walbro Corporation, Cass City, Mich.

[21] Appl. No.: 929,783

[22] Filed: Aug. 13, 1992

[51] Int. Cl.[5] ..... F02M 55/02

[52] U.S. Cl. ..... 123/456; 123/468; 123/469

[58] Field of Search ..... 123/456, 468, 469, 470, 123/472

[56] References Cited

U.S. PATENT DOCUMENTS

| | | | |
|---|---|---|---|
| 4,519,368 | 5/1985 | Hudson, Jr. | 123/468 |
| 4,776,313 | 10/1988 | Freismuth et al. | 123/468 |
| 4,798,187 | 1/1984 | Hudson, Jr. | 123/469 |
| 4,805,575 | 2/1989 | de Concini et al. | 123/468 |
| 4,971,014 | 11/1990 | Usui | 123/468 |
| 4,996,961 | 3/1991 | Usui | 123/470 |
| 5,044,338 | 9/1991 | Shelton | 123/456 |
| 5,056,489 | 10/1991 | Lorraine | 123/456 |
| 5,062,405 | 11/1991 | Daly | 123/456 |
| 5,074,269 | 12/1991 | Herbon et al. | 123/456 |
| 5,076,242 | 12/1991 | Parker | 123/468 |
| 5,094,211 | 3/1992 | Mahnke et al. | 123/456 |
| 5,105,787 | 4/1992 | Imoehl | 123/469 |
| 5,136,999 | 8/1992 | Bassler et al. | 123/456 |

*Primary Examiner*—E. Rollins Cross
*Assistant Examiner*—Thomas Moulis
*Attorney, Agent, or Firm*—Harold F. Mensing

[57] ABSTRACT

An injection molded fuel injection rail for an automotive engine. The fuel rail is designed to supply fuel to a plurality of electromagnetic fuel injectors oriented at acute angles relative to vertical. The socket inlet apertures through which fuel is fed from the rail interior into the respective fuel injector sockets are located in the bottom of the rail. This prevents the ingestion of vapor, which is normally present in the upper portion of the rail, into the injectors. In order to maintain both sides of these socket inlet apertures at substantially the same level the tilted injector sockets are provided with an occlusive lip along the high side of each inlet aperture. Additionally, the tilted socket axes may be offset laterally downward from the longitidinal rail axis. A plug type fitment is used to close the barrel core pin opening at one end of the rail. It is retained in the opening by a zero compressive load retainer which engages a cooperating annular shoulder structure formed on that end of the rail. To insure uniform distribution of the plastic injected into the mold and to prevent relative movement of the core pins by the force of the injected plastic during the molding process, a sprue site is located above each fuel injector socket in offset parallel alignment with the socket axis.

19 Claims, 2 Drawing Sheets

MOLDED FUEL INJECTION RAIL

This invention relates to a fuel rail for an automotive engine with electromagnetic fuel injectors. More specifically, it relates to a molded fuel rail having geometric features and relationships which enhance its production by injection molding and provide other advantages.

BACKGROUND OF THE INVENTION

In the past fuel rails were generally made by bonding a number of metal components together or by intricately machining each rail from a single block of metal stock. Attempts have been made to replicate the metal fuel rails in plastic but these attempts have not been overwhelmingly successful until now. Numerous obstacles had to be overcome to produce a molded plastic fuel rail having all of the required features. One major problem in producing a plastic fuel rail by injection molding processes involved the location of the fuel outlets from the rail barrel to the injector sockets. To provide maximum protection against the ingestion of fuel vapors, normally present in the top portion of the rail bore, into the fuel injectors, the fuel outlets should be located in the bottom portion of the rail body. Space limitations and other factors require the injector socket axes to be oriented at an acute angle relative to verticle. State-of-the-art injection molding practices did not provide a means for locating the rail-to-socket fuel outlets in the bottom of the rail body when the sockets were oriented at an angle to vertical. A related problem involved support for the elongated core pin for the fuel rail barrel when the socket core pins were placed off center to produce the aforementioned arrangement between the sockets and the rail body. Sound molding procedures dictated that the axes of the laterally disposed socket core pins be aligned with the axis of the barrel core pin so that the barrel core pin could rest on the centers of the socket core pins and thus be given adequate support during the plastic injection stage.

Another problem is that molded plastic items have a tendency to fail if certain areas are subjected even to minimal compressive loads for a prolonged period of time. Because of this trait it was difficult to provide a suitable structural arrangement for closing the core pin access opening located at one end of the rail body.

Accordingly, it is a general object of this invention to provide a high quality, durable fuel rail that can be readily and reliably molded.

It is a another object of this invention to provide a special configuration for a fuel rail which meets certain requirements and can be produced from plastic material by injection molding.

It is a another object of this invention to provide a molded fuel rail having a series of fuel injector sockets which communicate with the rail interior through apertures located in the bottom of the rail body and which are obliquely disposed relative to a vertical plane containing the rail axis.

It is yet another object of this invention to produce such a fuel rail having an end with a zero compressive load closure.

SUMMARY OF THE INVENTION

Generally speaking, the molded fuel rail of this invention has an elongated tubular barrel with a series of laterally disposed electromagnetic fuel injector sockets communicating with its hollow interior through socket inlets located in the botton of the rail barrel. The axes of the sockets are acutely angled laterally relative to a vertical plane containing the barrel axis. In order to have the socket inlets not extend significantly up one side of the barrel under these parameters, the socket axes are offset laterally and downwardly from the barrel axis and an occlusive lip is provided along one side of each inlet opening to bring the level of that side down to the level of the opposite side. To insure uniform distribution of the plastic injected into the mold and to prevent relative movement of the core pins by the force of the injected plastic during the molding process, sprue sites are provided at each injector socket location. Each site is centered at a point on the surface of the rail barrel generated by a line lying parallel to the corresponding socket axis and on the barrel axis side of the socket axis. The ingress and egress opening for the barrel core pin is closed by a plug member held by a zero compressive load cap and shoulder structure.

The details of this invention and its advantages will be understood best if the following description is read in conjunction with the accompanying drawings.

DETAILED DESCRIPTION OF THE INVENTION

Figure 1:
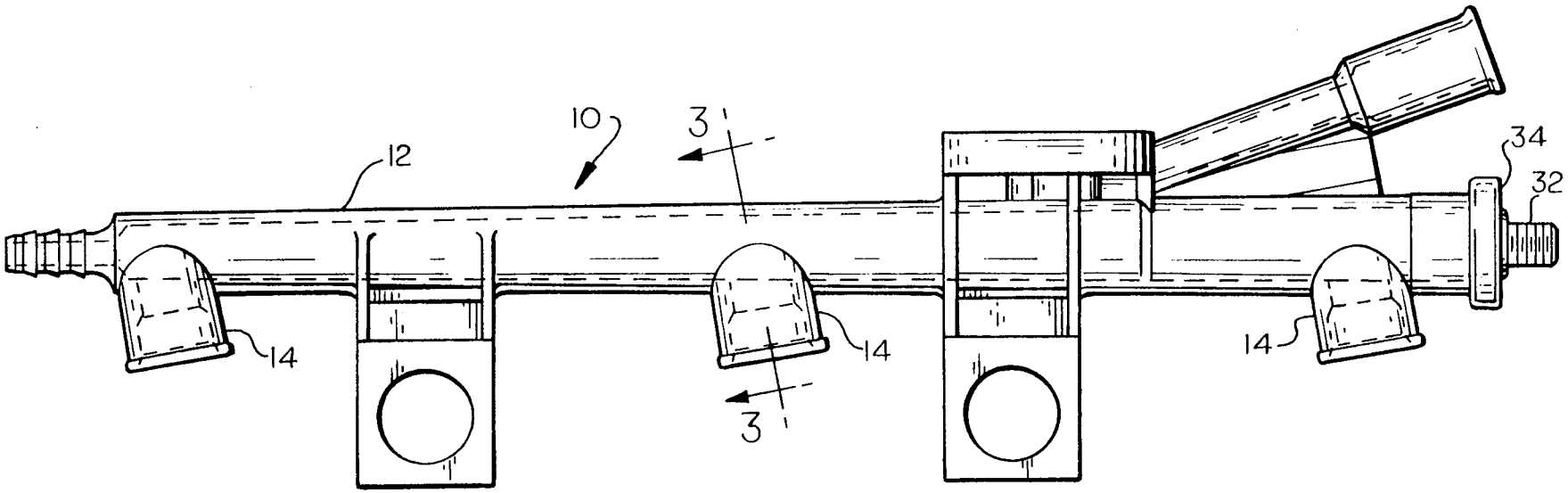
FIG. 1 is a side view of a preferred embodiment of the molded fuel injection rail of this invention.

The molded fuel rail 10 of this invention is made preferably of a dimensionally stable glass filled thermo plastic material, such as polyphenylene sulfide, by an injection molding process. It has a straight elongated tubular body or barrel 12 with a slight taper from a first end to a second end and a series of laterally disposed electromagnetic fuel injector sockets 14. Each injector socket has a hollow cylindrical cup section 16 with a strealined entrance 18 at one end and a coaxially aligned hollow cylindrical neck section 20 of reduced diameter at the other end. The innermost end of each socket neck section defines a rail barrel-to-socket fuel outlet opening 22.

Each of the socket axes is angled in a longitudinal direction towards one end of the rail such that the angle, between it and a plane disposed perpendicular to the axis of the rail barrel and extending downwardly therefrom, is an acute angle. Also, the socket axes are canted laterally from a vertical plane passing downwardly from the rail axis such that, when the fuel rail is mounted in its normal orientation on an engine, the angle from vertical is an acute angle. In the preferred embodiment illustrated in the drawings the longitudinal angle is approximately 10 degrees whereas the lateral angle is 21 degrees. The precise amounts of angularity are not significant as far as this invention is concerned because they are dictated normaly by extraneous conditions. The important features relate to how molded plastic fuel rails can be produced, particularly injection molded fuel rails, which meet the normal specifications for angularity yet have their fuel rail barrel-to-socket oulets located in the very bottom of the rail barrel.

Figure 3:
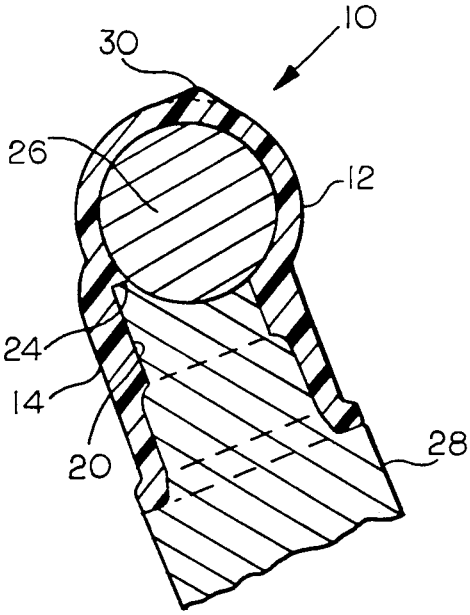
FIG. 3 is an enlarged cross sectional view taken along lines 3—3 of FIG. 1 with the addition of core pins.

One element that serves to achieve this result is an occlusive protuberance or lip 24 formed along the high side of the outlet opening 22. It juts into the opening from that side a sufficient amount to bring the corresponding edge of the opening to a level equal to the level of the edge on the opposite side of the opening when the rail is mounted on the engine in its normal orientation. This may be accomplished by merely foreshortening the socket forming core pin in this area. Another feature which may be used to decrease the level of the high side edge is to offset the socket axes laterally downward from the rail barrel axis as shown in FIG. 3. Preferably, the amount of lateral offset is one fifth or less of the internal diameter of the injector socket. Although these features are used in conjunction with one another in the illustrated embodiment, it is to be understood that one or the other of them may be used by itself.

The offsetting of the axes of the sockets creates a problem with the injection molding of the fuel rail. Lateral stability of the barrel core pin 26 is reduced due to the asymmetric position of the offset socket core pins 28. Normally, the barrel core pin would be nested in mating concavities centered on the heads of the socket core pins and thus be supported against lateral movement produced by the impact of the injected plastic during filling of the mold. To compensate for the offset socket axes, an injection sprue site 30 is provided at each socket location. Each site is centered at a point on the surface of the rail barrel generated by a line running parallel to the corresponding socket axis and located on the barrel axis side of the socket axis. Preferably, this line is contained in a cross sectional plane containing the socket axis and is located on the side of the barrel axis opposite from the socket axis side. Providing a sprue site at each injector socket location along the rail barrel enhances the rapid, complete and uniform filling of the entire mold cavity, particularly the appending socket portions thereof.

Figure 4:
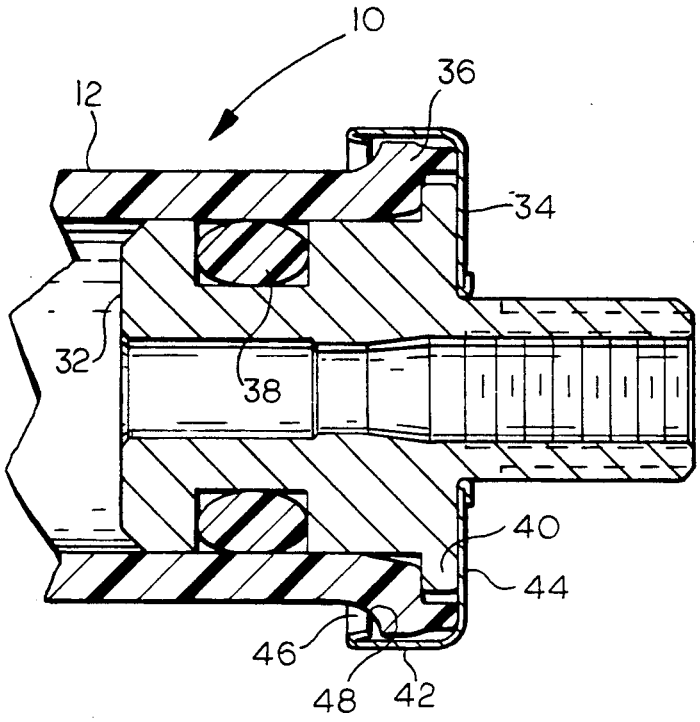
FIG. 4 is an enlarged sectional view of the barrel core pin access opening end portion of the fuel rail.
Figure 2:
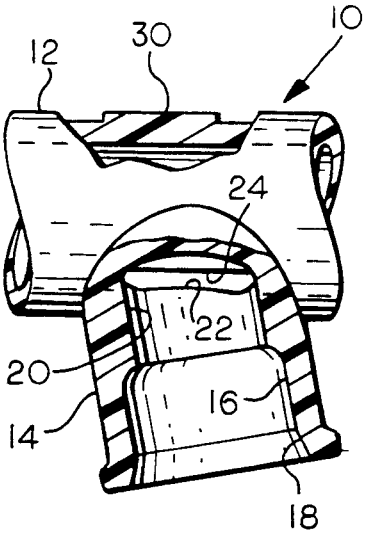
FIG. 2 is an enlarged view of a portion of the fuel rail with parts broken away to show additional details of an injector socket and adjacent spue site.

The ingress and egress opening for the barrel core pin, found at the right end of FIG. 1 and shown in the enlarged sectional view of FIG. 4, is closed by an inserted plug member 32 secured by a zero compressive load retainer or cap 34 snapped over a cooperating shoulder structure 36. The plug member illustrated in the drawings is designed to accomodate a pressure relief fitting, such as a Schrader Valve, on its outside end. A resilient "O-ring" seal 38 is provided in an annular groove surrounding the head end of the plug. An annular flange 40 on the tail end of the plug member is fitted into a corresponding annular groove formed on the inside corner of the adjacent end of the rail barrel. It positions the end face of the plug member flush with the barrel end. The retainer cap has a cylindrical body section 42 with a laterally inwardly disposed annular face section 44 at one end and an annular barb 46 on the inside edge of the other end. Preferably, the annular barb is formed by turning an edge portion of the cap back upon itself inwardly. The shoulder 36 has an inclined annular surface going from a lesser diameter at its outer end to a greater diameter where it terminates in an abrupt arcuate section 48. The greater diameter of the shoulder essentially matches the inside diameter of the cap body section but is greater than the inside diameter of the annular barb which in turn is greater than the smaller diameter portion of the shoulder. Another notable feature is the relative axial lengths of the cap body and the shoulder. The inside axial length of the cap body measured to the inner termination of the barb is greater than that of the shoulder so that when the plug and cap are fully seated on the end of the rail there is axial clearance between them as can be seen in FIG. 4.

Although the invention has been described and illustrated with respect to one embodiment, it is to be understood that minor modifications may be made without departing from the scope of the invention which is defined primarily by the appended claims. For example, the teachings of this invention are not restricted to a molded fuel rail made of an organic plastic material but may be applied to a molded fuel rail made of an inorganic or metallic material.

What is claimed is:

1. A molded fuel injection rail designed to be mounted in a specific orientation on an internal combustion engine, said injection rail comprising: an elongated rail barrel having a hollow interior with a longitudinal central axis, a plurality of injector sockets positioned at spaced locations along the underside of said rail barrel for supplying fuel to a like plurality of fuel injectors through socket apertures communicating with the interior of said rail barrel, said sockets each having a body portion with cylindrical cavity and a central axis disposed at an acute angle relative to vertical, said sockets axes being offset laterally from said rail barrel axis such that the elevation of the barrel-to-socket apertures is lowered relative to said rail barrel axis when said injection rail is in its normal orientation.

2. A molded fuel injection rail according to claim 1 wherein said socket axes are offset laterally from said rail barrel axis a distance nominally equivalent to one-fifth the diameter of said body cavity portion.

3. A molded fuel injection rail according to claim 1 further including an injection molding sprue site at each socket location.

4. A molded fuel injection rail according to claim 3 wherein each of said sprue sites is centered at a point on the surface of the rail barrel generated by a line running parallel to the corresponding socket axis and located on the barrel axis side of the socket axis.

5. A molded fuel injection rail according to claim 4 wherein said parallel line is contained in a cross sectional plane containing the socket axis and is located on the side of the barrel axis opposite from the socket axis side thereof.

6. A molded fuel injection rail according to claim 1 wherein said injector sockets each have a hollow cylindrical body merging at a shoulder with a hollow neck section of a reduced internal diameter and an occlusive protuberance projecting into said socket aperture from one side thereof to reduce the level of that side of the aperture.

7. A molded fuel injection rail according to claim 1 wherein said rail barrel has an axially disposed opening at one end, a plug member inserted in said one end, an annular shoulder on the outside of said end, and a zero compressive load cap cooperating with said shoulder to retain said plug in said end.

8. A molded fuel injection rail comprising: an elongated tubular rail member, a plurality of injector sockets located at spaced apart locations on said rail for supplying fuel to a like plurality of fuel injectors through socket apertures communicating with the hollow interior of said rail member, said injector sockets each having a hollow cylindrical body merging at a shoulder with a hollow neck section of a reduced internal diameter, said hollow interior of said neck section terminating short of said hollow interior of said rail on at least one side of said socket neck thereby producing an occlusive lip along said side.

9. A molded fuel injection rail made of a dimensionally stable plastic material comprising: an elongated tubular rail member, a plurality of injector sockets spaced along said rail member for supplying fuel to a like plurality of fuel injectors through socket apertures communicating with the interior of said rail member, a plug type fitment inserted in one end of said rail member, said end having an annular outer shoulder, a zero compression load cap for retaining said fitment in said end, said cap having a continuous annular barb with an internal diameter less than the external diameter of said shoulder but greater than the basic outer diameter of said rail member.

10. A molded fuel injection rail according to claim 9 wherein said shoulder has a first annular end section with a diameter less than the internal diameter of said cap but greater than the basic outside diameter of said rail member, an inclined annular intermediate section, and a second annular section having a diameter greater than that of said first section.

11. A molded fuel injection rail according to claim 9 wherein said cap has a cylindrical annular body with an axial length, minus the length of said barb, substantially greater than the axial length of said shoulder.

12. A molded fuel injection rail designed to be mounted in a specific orientation on an internal combustion engine, said injection rail comprising: an elongated rail barrel having a hollow interior with a longitudinal central axis, a plurality of laterally disposed injector sockets positioned at spaced locations along said rail barrel for supplying fuel to a like plurality of fuel injectors through socket apertures communicating with the interior of said rail barrel. said sockets each have an occlusive protuberance projecting into said socket aperture from one side thereof to reduce the level of that side of the aperture, said sockets each having a body portion with cylindrical cavity and a central axis disposed at an acute angle relative to said barrel axis, said sockets axes being offset laterally and downwardly from said rail barrel axis.

13. A molded fuel injection rail according to claim 12 wherein said socket axes are offset laterally from said rail barrel axis a distance nominally equivalent to one-fifth the diameter of said body cavity portion.

14. A molded fuel injection rail according to claim 12 further including an injection molding sprue site at each socket location.

15. A molded fuel injection rail according to claim 14 wherein each of said sprue sites is centered at a point on the surface of the rail barrel generated by a line running parallel to the corresponding socket axis and located on the side of the barrel axis opposite that of the socket axis side thereof.

16. A molded fuel injection rail according to claim 15 wherein said parallel line is contained in a cross sectional plane containing the socket axis.

17. A molded fuel injection rail according to claim 12 wherein said sockets each have a hollow cylindrical body merging at a shoulder with a hollow neck section of a reduced internal diameter, said hollow interior of said neck section terminates short of said hollow interior of said rail barrel on one side of said socket neck such that an occlusive lip is produced along said side only.

18. A molded fuel injection rail for an internal combustion engine, said injection rail comprising: an elongated rail barrel having a hollow interior with a longitudinal central axis, a plurality of laterally disposed injector sockets positioned at spaced locations along said rail barrel for supplying fuel to a like plurality of fuel injectors through socket apertures communicating with said interior, said sockets each having a body portion with cylindrical cavity and a central axis disposed at an acute angle relative to said barrel axis, said sockets axes being offset laterally and downwardly from said rail barrel axis, said sockets each have a hollow cylindrical body merging at a shoulder with a hollow neck section of a reduced internal diameter, said hollow interior of said neck section terminates short of said hollow interior of said rail barrel on one side of said socket neck such that an occlusive protuberance is produced along said side only to reduce the level of that side of the aperture.

19. A molded fuel injection rail according to claim 18 made of a dimensionally stable plastic material wherein said rail barrel has an axially disposed opening at one end, a plug member inserted in said one end, an annular shoulder on the outside of said end, and a zero compressive load cap cooperating with said shoulder to retain said plug in said end.

* * * * *